US007401718B2

(12) United States Patent
Rowe

(10) Patent No.: US 7,401,718 B2
(45) Date of Patent: Jul. 22, 2008

(54) ARRANGEMENT FOR AXIAL FEED OF A SUPPLY HOSE

(75) Inventor: Michael A. Rowe, Karlstad (SE)

(73) Assignee: Metso Fiber Karlstad AB, Karlstad (SE)

( * ) Notice: Subject to any disclaimer, the term of this patent is extended or adjusted under 35 U.S.C. 154(b) by 776 days.

(21) Appl. No.: 10/784,455

(22) Filed: Feb. 23, 2004

(65) Prior Publication Data

US 2005/0011969 A1 Jan. 20, 2005

(30) Foreign Application Priority Data

Jul. 14, 2003 (SE) ..... 0302076

(51) Int. Cl.
*B65H 20/00* (2006.01)

(52) U.S. Cl. ..... 226/182; 226/193; 226/176; 242/422

(58) Field of Classification Search ..... 226/170–173, 226/176, 181, 182, 193, 194, 114; 242/416, 242/422, 422.4, 422.8
See application file for complete search history.

(56) References Cited

U.S. PATENT DOCUMENTS

| | | | | |
|---|---|---|---|---|
| 1,759,105 | A * | 5/1930 | Evans | 57/138 |
| 3,589,580 | A * | 6/1971 | Smulders | 226/108 |
| 4,285,454 | A * | 8/1981 | Plumettaz | 226/174 |
| 5,547,065 | A * | 8/1996 | Watanabe et al. | 198/604 |
| 5,823,712 | A * | 10/1998 | Kalkman et al. | 405/165 |
| 6,260,834 | B1 * | 7/2001 | Colonel et al. | 267/73 |
| 6,439,445 | B1 * | 8/2002 | De Groot et al. | 226/172 |
| 6,619,432 | B1 * | 9/2003 | Yasui | 187/250 |
| 7,021,510 | B2 * | 4/2006 | Ellingson | 226/172 |
| 2006/0081731 | A1 * | 4/2006 | Niederer | 242/421 |
| 2006/0208245 | A1 * | 9/2006 | Diehl | 254/265 |

FOREIGN PATENT DOCUMENTS

| | | | |
|---|---|---|---|
| GB | 2037392 | A * | 7/1980 |
| JP | 2001300458 | A * | 10/2001 |
| SE | 502317 | * | 10/1995 |

* cited by examiner

*Primary Examiner*—Evan H Langdon
(74) *Attorney, Agent, or Firm*—Fasth Law Offices; Rolf Fasth

(57) ABSTRACT

The arrangement is for the axial driving of a supply hose (11) for pressure medium or application medium in the form of fluid, gaseous or solid, granule-formed or powder-formed, material. The supply hose (11) is connected to a displaceable cartridge (42) provided with at least one spray nozzle (43). The cartridge (42) is arranged in a guide tube (41) along an object that is to be sprayed. The arrangement has three driving wheels (21), where at least one driving wheel (21*a*) is driven by driving means and where each driving wheel (21) has a concave jacket surface (27) congruent with the supply hose (11). The concave jacket surface (27) surrounds the supply hose to at least 100° degrees of the circumference of the supply hose (11).

13 Claims, 4 Drawing Sheets

ARRANGEMENT FOR AXIAL FEED OF A SUPPLY HOSE

PRIOR APPLICATION

This application is a U.S. national phase application based on and claiming priority from Swedish Patent Application No. C302076-5 filed 14 Jul. 2003.

The present invention concerns an arrangement for the axial feed of a supply hose.

THE PRIOR ART

It is known that environmental problems arise when carrying out painting, cleaning, blasting, etc., where spraying with nozzles takes place, often under high pressure. These problems make it difficult for the personnel employed to remain close to the place of work. It may also be difficult to satisfy applicable environmental requirements, particularly if one is working with contaminating or corrosive fluids or other spray media. It is often difficult to build constructions using screens or other enclosures to protect the personnel, and to be able to collect sprayed excess medium and used pressure medium (the spraying agent).

SE502317 reveals an arrangement that is to combat the problems described above in that a guide tube is to be arranged to be placed along the object that is to be sprayed. The guide tube is provided with longitudinal slits, and is equipped with a cartridge that is arranged to be displaceable forwards and backwards along this. The cartridge is equipped with one or several spray nozzles. Furthermore, the cartridge is connected to a supply hose for pressure medium or spray medium, such as water, air, cleaning fluid, paint, sand, etc. The cartridge is displaced forwards and backwards in the guide tube with the aid of the supply hose, which is in turn driven with the aid of two pairs of friction wheels on each side of the supply hose. The arrangement of driving the supply hose with friction wheels as described above involves a number of disadvantages and problems.

- The area of contact between the supply hose and the friction wheels is small, which means that a high pressure is required from the friction wheels onto the supply hose in order to obtain sufficient friction to drive the supply hose. This will result in the long term in wear of the supply hose.
- Pulses directed in the radial direction may arise when working at high pressure, leading to a local deformation of the hose. This accelerates the wear of the supply hose from the friction wheels.
- A radially pulsing supply hose may also result in damage to the bearing mountings of the axles of the friction wheels.
- When a supply hose has been damaged through wear it must be exchanged, something that makes it necessary to halt production, and in this way loose income. It is also both time-consuming and complicated from the point of view of service to exchange a supply hose.
- A complete high-pressure supply hose with connectors costs between SEK 5,000 and SEK 15,000 (hose length 5-15 meters), and this means that also from the point of view of economics it is of interest to maintain the interval between exchange at a minimum.

A drive device with two pairs of driving wheels is also revealed in GB 2037392. The driving wheels have the form of friction wheels that grip around the hose to feed the hose forwards. The driving arrangement is mounted in this case in an apparatus for flushing drains in which the hose is to be fed into the drain and subsequently withdrawn. Continuous driving inwards and outwards is not relevant in this case.

U.S. Pat. No. 4,592,282 shows feeding of hose-formed explosive into a drilled hole using a similar driving arrangement with pairs of wheels. Also in this case, a continuous driving arrangement for continuous forwards and backwards feed is not concerned.

A hose-feed apparatus is also revealed in U.S. Pat. No. 4,240,017 with pairs of driving wheels, one driving roller that grips against the hose and against a tension roller.

A cleaning apparatus for drains in which a hose is fed out is revealed in the Japanese patent 2001-300458. Three obliquely placed rotation wheels are used to achieve rotation of the hose in this case. Each rotation wheel is placed at an oblique angle of 45° degrees to the direction of feed of the hose, and the rotation wheel exerts a contact force against the hose along a pressure line (an edge). This results in heavy wear on the hose.

AIM AND PURPOSE OF THE INVENTION

One object of the present invention is to achieve an arrangement adapted for continuous forwards and backwards driving of a supply hose, which arrangement wholly or partially solves the disadvantages and problems described above. Wear of the supply hose that arises when using previously known solutions can be significantly reduced in accordance with the invention.

The arrangement for axial driving of a supply hose for pressure medium or spray medium in the form of fluid, gaseous or solid, granule-formed or powder-formed, material according to the invention is characterised in that the arrangement has three driving wheels with concave jacket surfaces, which jacket surfaces make contact in a congruent manner with the supply hose and surround the hose around at least 100° degrees of the circumference of the supply hose. The present invention has a greater total area of contact with the supply hose, divided into sections, which gives higher friction against the driving wheels. This means that the contact pressure between the driving wheels and the supply hose can be relatively low. This in turn means that wear of the supply hose is reduced.

In order to further reduce wear of the supply hose, the driving wheels should be manufactured, at least in their concave jacket surfaces, from a polymer material with a coefficient of friction, $\mu>0.8$ and preferably $\mu>0.9$, between any driving wheel and the supply hose. Furthermore, the driving wheels should be manufactured, at least in their concave jacket surface, from a polymer material with a hardness that is equal to, or preferably, lower than, the hardness of the supply hose. This leads to the driving wheels being worn instead of the supply hose. It is both easier and significantly cheaper from the point of view of service to exchange the driving wheels. A driving wheel costs less than SEK 100, which is to be compared with SEK 5,000- SEK 15,000 for a supply hose.

DESCRIPTION OF DRAWINGS

The invention will now be described in more detail through description of embodiments with reference to the attached drawings, in which.

DETAILED DESCRIPTION OF PREFERRED EMBODIMENTS

Figure 1:
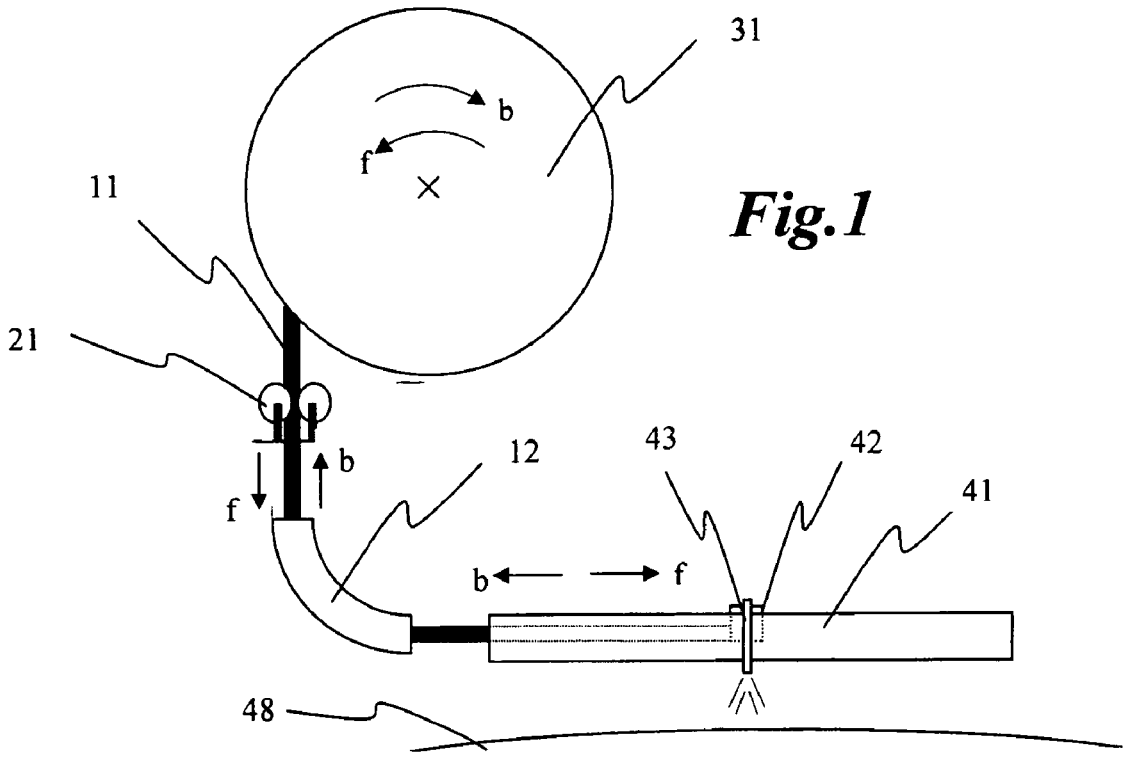
FIG. 1 shows a sketch of the principle for a system in which the arrangement according to the invention is included.

FIG. 1 shows a guide tube 41 placed along an object (not shown) that is to be sprayed. A forwardly and backwardly displaceable cartridge 42 is located in the guide tube 41, which cartridge is provided with one or several spray nozzles 43. The cartridge 42 is connected to a supply hose 11 for pressure medium or spray medium in the form of fluid, gaseous or solid, granule-formed or powder-formed material, such as, for example, water, air, cleaning fluid, paint, sand, etc. The cartridge 42 is driven along the guide tube 41 by the supply hose 11. The supply hose 11 is, in turn, driven forwards and backwards along its axial direction by means of three driving wheels 21 (one driving wheel is hidden in FIG. 1). The driving wheels 21 will be described in more detail below, see FIGS. 2*a* and 2*b*. When the supply hose 11 is driven in a forwards direction (f) it is dispensed from a hose magazine 31, and when it is driven in a backwards direction (b) it is collected onto the hose magazine 31. The hose magazine will be described in more detail below, see FIG. 3.

A scraper 12 is arranged between the driving wheels 21 and the guide tube 41, which scraper comprises at least one sealing arrangement (not shown in the drawing), which surrounds and seals the supply hose 11. A first aim of the scraper 12 is to scrape away any material/deposits from the supply hose 11 such that the friction between it and the driving wheels 21 is not degraded in such a manner that slipping occurs between the driving wheels 21 and the supply hose 11. A second aim of the scraper 12 is to make possible introduction into a pressurised vessel. A third aim of the scraper 12 is to make possible deflection of the supply hose 11 at an angle.

Material/deposits may arise on the supply hose 11, since the present invention is used to clean a drum filter in the paper pulp industry. A drum filter is a drum with a perforated strainer plate on the jacket surface, which surface rotates during operation. Furthermore, the drum filter is placed into a vessel with added weak liquor and lime sludge (which contains slaked lime). The water-part of the contents of the vessel are sucked through the strainer plate by applying a vacuum to the inside of the drum, by which means what is known as a "precoat layer" is formed. i.e. material of the contents of the vessel. The guide tube 41 is applied along the drum. A cartridge 42 is moved, forwards and backwards with the aid of a supply hose 11 into the guide tube 41. Water under pressure is supplied through the supply hose 11 and is spayed through spray nozzles 43 for removal of precoat and for cleaning the strainer plate of the drum. Part of this material may thus become attached to the supply hose 11.

Figure 2A:
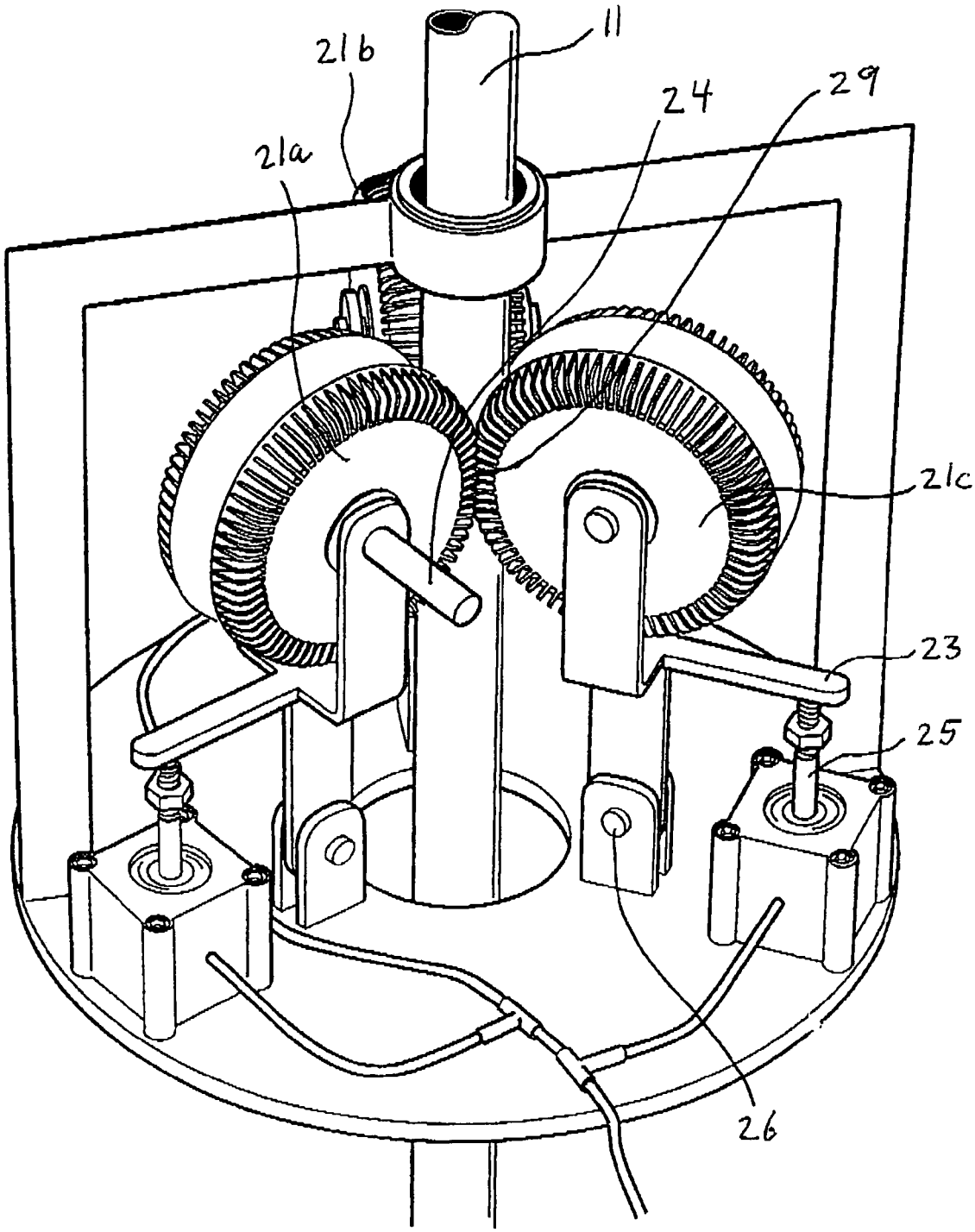
FIG. 2*a* shows an embodiment of the driving wheels, where the contact pressure against the supply hose is controlled with the aid of elements under pneumatic control.
Figure 2B:
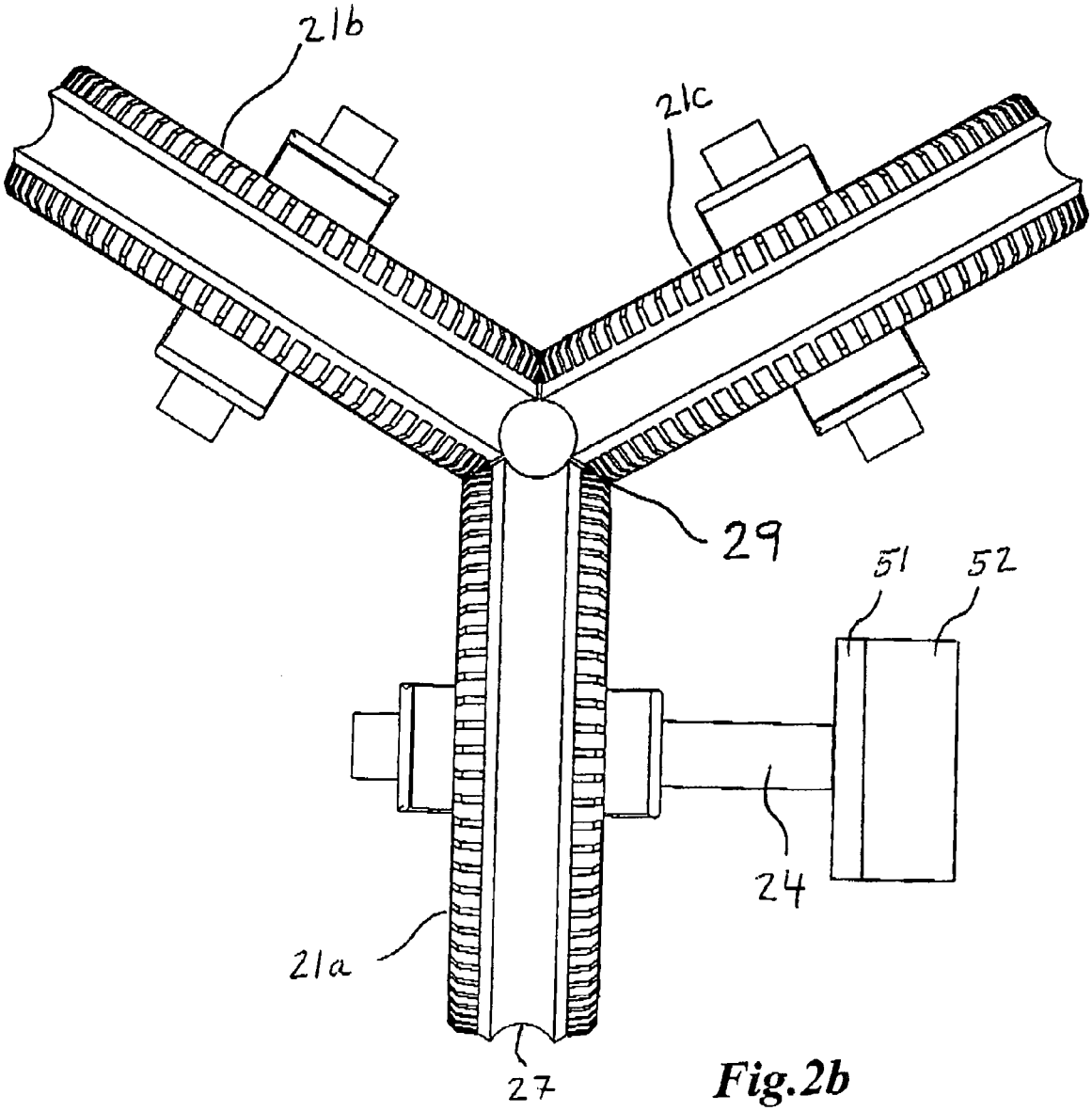
FIG. 2*b* shows an embodiment in which a motor is connected through a gear to one of the axles of the driving wheels.

FIGS. 2*a* and 2*b* show an embodiment of the arrangement according to the invention for achieving an axial driving motion of the supply hose 11. The arrangement is characterised in that it comprises three driving wheels 21, where each driving wheel has a concave jacket surface 27 congruent with the supply hose 11. The concave jacket surface 27 surrounds the supply hose 11 around at least 100° degrees of the circumference of the supply hose 11. At least one of the driving wheels 21*a* is driven to rotate by driving means, preferably a motor. FIG. 21*b* shows an embodiment in which the axis 24 of the driving wheel 21*a* is driven by a motor 52, preferably through a gear 51. One example of the gear 51 is a drive belt between the axle 24 and the motor 52.

The outer sides of each driving wheel 21 are in physical contact with each other 29 in such a manner that the driving wheel 21*a* drives the other two driving wheels 21*b* and 21*c* through its rotation. An embodiment is shown in FIGS. 2*a* and 2*b* in which the outer jacket surfaces of the driving wheels 21 are provided with teeth 28 that enter into a shape-determined engagement with the teeth of a neighbouring driving wheel, and ensure that no slippage occurs between the driving wheels 21 when under driven rotation. Another embodiment (not shown) has instead of teeth plane surfaces with a high coefficient of friction $\mu>0.8$, preferably $\mu>0.9$, between the driving wheels 21 at their surfaces of contact 29.

FIG. 2*a* is shows an embodiment of the invention where the contact pressure between the driving wheels 21 and the supply hose 11 is controlled with the aid of three individually sprung elements 25, which are arranged to interact with the mounting of each driving wheel 21 through levers 23. When increased contact pressure is required, the sprung element 25 is pressed upwards against the lever 23 such that the driving wheels are pressed in towards the supply hose 11. Since the mounting of the driving wheels is jointed 26 the bearings of the driving wheel will not be damaged if any radial unevenness or deformations are present in the supply hose 11, caused by a high working pressure in the supply hose 11.

FIG. 2*a* shows a preferred embodiment in which the sprung element 25 is constituted by a pneumatic cylinder in which the piston rod 25 makes contact with the lever 23.

Since the three driving wheels 21 surround the supply hose 11 congruently, the contact area and thus the friction between the driving wheels and the supply line 11 will be large, which in turn means that a low contact pressure is sufficient in order to achieve satisfactory friction for driving the supply hose 11, and this gives reduced wear of the supply hose 11.

It is preferable that the driving wheel 21, or solely the concave jacket surfaces (27), are manufactured from a polymer material with a hardness that is equal to the hardness of the supply line 11, or preferably, lower than the hardness of the supply line 11. Furthermore, the coefficient of friction between the concave jacket surfaces 27 of the driving wheels 21 should be $\mu>0.8$ and preferably $\mu>0.9$.

Figure 3:
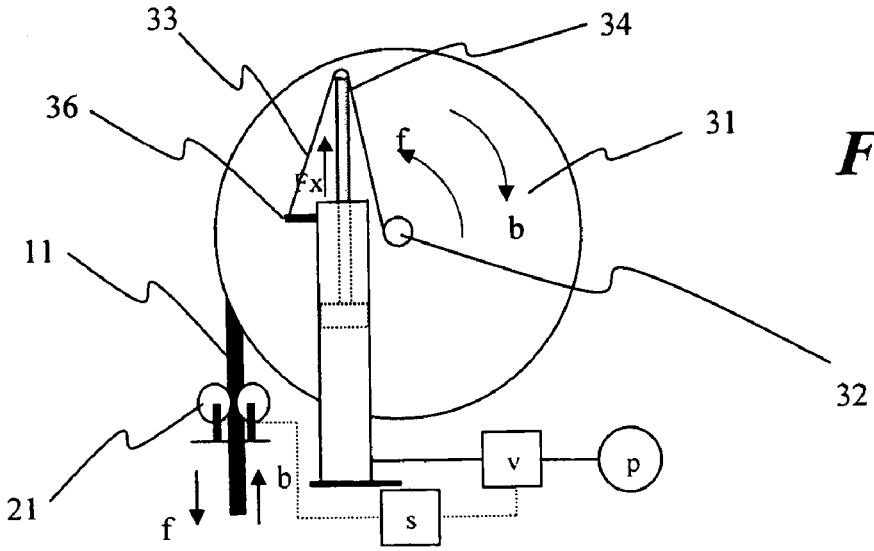
FIG. 3 shows an embodiment of a hose magazine in which pneumatically controlled elements compensate for slack in the supply hose.

FIG. 3 shows a hose magazine 31 onto which the supply hose 11 is rolled on and off. When the supply hose 11 is driven in the forwards direction (f), the supply hose 11 is dispensed from the hose magazine, which in this case rotates in the direction (f) of unrolling. When the supply hose 11 is driven in the backwards direction (b), the supply hose 11 is collected onto the hose magazine 31, which in this case rotates in the direction (b) of collection. A pulley wheel 32 is located at the centre of the hose magazine, arranged fixed relative to the hose magazine and rotating with it, onto which pulley a tension strap 33 is arranged. The tension strap 33 passes over a sprung element 34 and the tension strap is at its outer end fixed attached to an attachment 36, fixed in space. The sprung element has a low level (Fx) of force when the supply hose is driven in the forwards direction (f), and it has a high level (Fx) of force when the supply hose is driven in the backwards direction (b). When the driving wheels 21 drive the supply hose 11 in the forwards direction, the hose magazine is set into rotation in the direction (f) of dispensing by the drawing force from the supply hose 11, the tension strap 33 is in this case wound up onto the pulley 32, which rotates with the hose magazine 31, and this means that the tension strap 33 presses down onto the sprung element 34. Since the sprung element has a low level (Fx) of force, the tension strap 33 is maintained extended all the time, and ensures that the hose magazine 31 does not rotate too rapidly, rather that the supply hose 11 is maintained extended between the driving wheels 21 and the hose magazine 31.

In the case when the driving wheels 21 drive the supply hose 11 in the backwards direction (b), the hose magazine is caused to rotate in the direction (b) of collection in that the sprung element 34 has a high level (Fx) of force directed in the direction (b) of collection such that the tension strap 33 rolls off from the pulley 32 which then starts to rotate with the hose magazine in the collection direction (b). The sprung element 34, which has a high level (Fx) of force, maintains the tension strap 33 extended and ensures that the hose magazine does not rotate too slowly, rather that the supply hose 11 is maintained extended between the driving wheels 21 and the hose magazine 31. One preferred embodiment is shown in FIG. 3 in which the sprung element 34 is constituted by a pneumatic cylinder in which the tension strap 33 makes contact with the piston rod 34. A sensor (s) detects whether the supply hose 11 is being driven in the forwards direction (i.e. the direction of dispensing (f) for the hose magazine) or in the backwards direction (i.e. the direction of collection (b) for the hose magazine). The signal from the sensor (s) is sent to a pressure valve (v) which is in turn connected to a pressure source (p). In the case in which the supply hose is driven in the forwards direction (f), the pressure valve (v) is opened, which causes a low level of force in the pneumatic cylinder. In the case in which the supply hose is driven in the backwards direction (b), the pressure valve (v) is closed, which causes a high level of force in the pneumatic cylinder.

Figure 4:
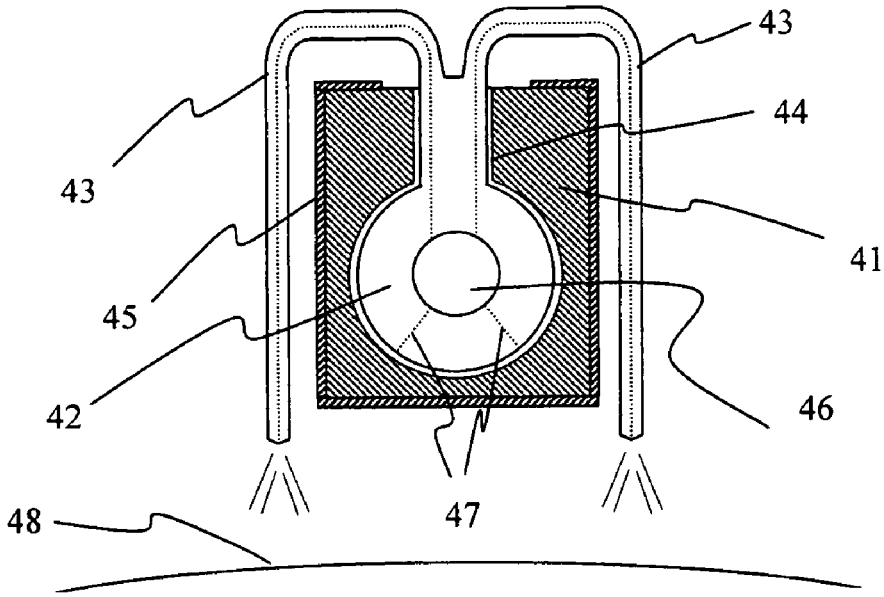
FIG. 4 shows a cross-section of a side view of a guide tube that comprises a cartridge and associated spray nozzles.

FIG. 4 is shows a cross-section of an embodiment of a guide tube 41 placed along an object that is to be sprayed (not shown in the drawing). The guide tube 41 is manufactured from a polymer material and comprises a extended guide track 44 having the shape of a keyhole. A forwardly and backwardly displaceable cartridge 42 is arranged in the guide track 44. The cartridge 42 is equipped with one or several spray nozzles 43, and is connected to a supply hose 11. The cartridge 42 is displaced forwards and backwards in the guide tube 41 with the aid of the supply hose 11. The guide tube 41 is fixed and surrounded by an aluminium profile 45.

It is appropriate in one embodiment in which water is used as application medium that the cartridge 42 is provided with lubrication channels 47 that provide a calibrated leakage flow of fluid that maintains the guide track 44 clean and reduces friction between the cartridge 42 and the guide track 44.

The invention is not limited to the embodiments shown here; several variations are possible within the scope of the claims.

The invention claimed is:

1. An arrangement for the axial driving of a supply hose, comprising:

the supply hose being connected to a displaceable cartridge provided with a spray nozzle, the supply hose being in fluid communication with the spray nozzle, the cartridge being arranged in a stationary guide tube extending along an object to be sprayed, the cartridge being movable along the guide tube, the spray nozzle being movable along and relative to the guide tube, a first, second and third driving wheel, where at least one driving wheel is driven by driving means for driving the driving wheel, the first driving wheel having a first and second outside, the second driving wheel having a first and second outside, the third driving wheel having a first and second outside, the first outside of the first driving wheel being in contact with the second outside of the third driving wheel, the second outside of the first driving wheel being in contact with the first outside of the second driving wheel, the second outside of the second driving wheel being in contact with the first outside of the third driving wheel to enclose the supply hose disposed therein, each driving wheel having a concave jacket surface congruent with an outside of the supply hose, and each concave jacket surface surrounding at least 100° of a circumference of the supply hose.

2. The arrangement according to claim 1, wherein the driving wheels are in physical contact with each other in such a manner that there arises indirect driving of the other driving wheels driven by the first wheel.

3. The arrangement according to claim 2, wherein outer sides of the jacket surfaces on each driving wheel comprises teeth which enter into shape-determined interaction with the teeth of neighboring driving wheel.

4. The arrangement according to claim 2, wherein outer ends of the jacket surfaces are plane and in that the driving wheels have a coefficient of friction $\mu>0.8$ between each other.

5. The arrangement according to claim 1 wherein a contact pressure between the driving wheels and the supply hose is controlled by a spring element.

6. The arrangement according to claim 5, wherein the spring element is a pneumatic cylinder.

7. The arrangement according to claim 1 wherein the supply hose is rolled onto and out from a hose magazine.

8. The arrangement according to claim 7, wherein a pulley is located at a center of the hose magazine, which pulley is fixedly arranged relative to the hose magazine and rotates with the hose magazine, to which pulley a tension strap is attached, where the tension strap passes over a spring element and is fixedly attached at its outer end in a fixture fixed in space.

9. The arrangement according to claim 8, wherein the spring element has a low force level (Fx) when the hose magazine rolls in the dispensing direction (f) and a high force level (Fx) when the hose magazine rolls in a collection direction (b).

10. The arrangement according to claim 8 wherein the spring element is a pneumatic cylinder.

11. The arrangement according to claim 1 wherein a scraper is arranged between the driving wheels and the guide tube, with the purpose of scraping away any material deposited onto the supply hose.

12. The arrangement according to claim 11, wherein the scraper comprises at least one sealing arrangement, which surrounds the supply hose in a sealing manner.

13. The arrangement according to claim 1 wherein the concave jacket surfaces are manufactured from a polymer material with a hardness that is equal to that of the supply hose.

* * * * *